US007252333B2

(12) United States Patent
Caldwell

(10) Patent No.: US 7,252,333 B2
(45) Date of Patent: Aug. 7, 2007

(54) SELECTIVELY ROCKABLE CHAISE LOUNGE, STACKABLE, AND WITH ADJUSTABLE POSTURE SUPPORT

(76) Inventor: John W. Caldwell, 901 El Centro St., So. Pasadena, CA (US) 91030

( * ) Notice: Subject to any disclaimer, the term of this patent is extended or adjusted under 35 U.S.C. 154(b) by 142 days.

(21) Appl. No.: 10/884,307

(22) Filed: Jul. 3, 2004

(65) Prior Publication Data

US 2006/0001301 A1 Jan. 5, 2006

(51) Int. Cl.

| | |
|---|---|
| ***A47C 3/02*** | (2006.01) |
| ***A47C 3/03*** | (2006.01) |
| ***A47C 3/04*** | (2006.01) |
| ***A47D 13/10*** | (2006.01) |

(52) U.S. Cl. ..... 297/259.2; 297/258.1; 297/270.1; 297/270.2; 297/271.6; 297/239; 297/32

(58) Field of Classification Search ..... 297/258.1, 297/259.2, 270.1, 270.2, 270.3, 271.5, 271.6, 297/239, 32

See application file for complete search history.

(56) References Cited

U.S. PATENT DOCUMENTS

| | | | | | |
|---|---|---|---|---|---|
| 117,351 | A * | 7/1871 | Van Orden | ..... | 297/259.2 X |
| 170,293 | A * | 11/1875 | Newman | ..... | 297/270.2 X |
| 248,753 | A * | 10/1881 | Huston | ..... | 297/270.1 X |
| 597,581 | A * | 1/1898 | Kluenter | ..... | 297/270.2 X |
| 702,331 | A * | 6/1902 | Roberts | ..... | 297/259.2 X |
| 1,228,967 | A * | 6/1917 | Rho | ..... | 297/270.2 X |
| 1,421,260 | A * | 6/1922 | Kurnick | ..... | 297/270.2 X |
| 1,872,056 | A * | 8/1932 | Bielecky | ..... | 297/270.1 |
| 1,889,646 | A * | 11/1932 | Ernst | ..... | 297/270.2 X |
| 2,454,408 | A * | 11/1948 | Roth | ..... | 297/239 |
| 2,543,543 | A * | 2/1951 | Gomes et al. | ..... | 297/271.6 X |
| 4,010,978 | A * | 3/1977 | Rosen | ..... | 297/239 |
| 4,682,816 | A * | 7/1987 | Massonnet | ..... | 297/239 X |
| 5,178,438 | A * | 1/1993 | Beger | ..... | 297/271.6 |
| 5,868,459 | A * | 2/1999 | Welsh, Jr. | ..... | 297/258.1 X |
| 6,174,028 | B1 * | 1/2001 | Yang et al. | ..... | 297/258.1 |
| 6,361,106 | B1 * | 3/2002 | Huang | ..... | 297/32 X |
| 6,540,292 | B2 * | 4/2003 | Darling et al. | ..... | 297/258.1 X |
| 6,676,206 | B2 * | 1/2004 | Brandschain | ..... | 297/259.2 X |
| 6,682,137 | B2 * | 1/2004 | Hsia | ..... | 297/258.1 X |
| 6,811,217 | B2 * | 11/2004 | Kane et al. | ..... | 297/270.2 |
| 6,955,398 | B1 * | 10/2005 | Reese | ..... | 297/271.6 |

FOREIGN PATENT DOCUMENTS

| | | | | |
|---|---|---|---|---|
| EP | 357522 A1 * | 3/1990 | ..... | 297/239 |
| GB | 2179546 A * | 3/1987 | ..... | 297/258.1 |

* cited by examiner

*Primary Examiner*—Rodney B. White
(74) *Attorney, Agent, or Firm*—Donald D. Mon

(57) ABSTRACT

A rockable and stackable chaise lounge. It includes a pair of frame members each formed by a downwardly convex rocker and an upwardly convex rail joined at front and rear ends. The frames are joined at their front and rear ends by spreaders. Adjustable stops are provided to limit the extent of rocking. A seat with a reclining back is supported between the frame by the rails.

11 Claims, 6 Drawing Sheets

SELECTIVELY ROCKABLE CHAISE LOUNGE, STACKABLE, AND WITH ADJUSTABLE POSTURE SUPPORT

FIELD OF THE INVENTION

A chaise lounge especially suited for outdoor leisure usage. It is selectively rockable, stackable, and provides an adjustable back support.

BACKGROUND OF THE INVENTION

Chaise lounges for indoor use are generally substantial rigid articles of furniture placed in leisure and boudoir areas. They are intended to be stable furniture with a horizontal couch-like seat and a raised back support adjacent to part of the seat. Such lounges generally do not provide for adjustment of the angle of the backrest relative to the seat, neither are they intended to be rockable nor stackable.

Chaise lounges for outdoor, poolside, or cabana usage are generally of lightweight construction, often with wheels, and usually with an adjustable back support. These also are generally quite stable once the backrest has been adjusted.

Indoor chaises are generally not used in multiples in any area, and are not stored. Instead they are established articles of furniture decorated as to taste and dedicated to function. The same is not the situation for outdoor chaise lounges. Outdoor chaise lounges are most usually found around pools and terraces in substantial numbers, and are regularly moved from place to place as social events transpire, or at the end of the day. During some events or at the end of the day they are stored or otherwise grouped. Although they are light of weight, they are bulky items, so their storage can be, and often is, a problem.

Because of where they are used, outdoor chaise lounges are not generally provided with a rocking feature. Among problems that accompany the attributes of rockability are insufficient stability when sat upon as contrasted with being reclined upon, and insufficient stackability of numbers of them.

Chaise lounges for outdoor usage must be made lightweight, both for convenience and for economy of construction. This raises problems for providing an attractive product. Unattractive products sell poorly. Tubular elements are generally preferred for these products, for example aluminum alloy tubing. While such elements make for strong structures, lightness of weight, and lower cost, chaise lounges made from them, especially for an upper scale product, suffer aesthetically from limitations asserted by conventional assembly processes and the strength of the structural elements.

It is another object of this invention to provide such a lounge with structural elements and assembly that are economical, and when assembled are attractive. The lateral spacing between the rockers is greater than the lateral spacing between the rails. As a consequence the lounges can be stacked, because the rockers of an upper lounge can pass over the rails of a lower lounge.

It is another object of this invention to provide such an article of furniture which utilizes forces that are resistant to the linear extension of the furniture for supporting the weight of the occupant.

BRIEF DESCRIPTION OF THE INVENTION

A chaise lounge according to this invention has a forward and a lateral dimension and provides a couch-like seat and a back support. When permitted to rock, the lounge does so in a vertical plane normal to its forward and lateral dimensions. The lounge includes a pair of arcuate rockers in contact with the ground, and a pair of arcuate rails.

The rockers and rails are curved linear structures with a forward end and a rearward end. In laterally spaced apart pairs, their forward ends are structurally joined to each other, and their rearward ends are structurally joined to each other.

The curvatures of the rockers and rails are oppositely directed so that the rockers make point contact with the ground, while the rails rise above the runners, thereby forming on each lateral side an integral closed structure, with pointed front and rear ends, a downwardly facing convex surface contacting the ground, and an upwardly facing rail structure supporting a seat.

According to yet another feature of the invention, the rockers are formed with an arc that has a radius larger than the distance between the contact point of the runner and an occupant, whereby the tendency of an occupant to tip over is limited.

A rigid spreader is structurally attached to the forward ends, and a rigid rear spreader to the rearward ends.

According to a feature of this invention the rockers are spaced farther apart than the rails are separated, so the rockers can pass over the rails of a lower lounge, so the lounge is stackable.

Preferably the backrest is adjustable to vary its angle relative to the rails.

According to a preferred but optional feature of the invention, retractable stops on the rockers can selectively impede or prevent the rocking function.

The above and other features of this invention will be fully understood from the following detailed description and accompanying drawings, in which:

DETAILED DESCRIPTION OF THE INVENTION

Figure 1:
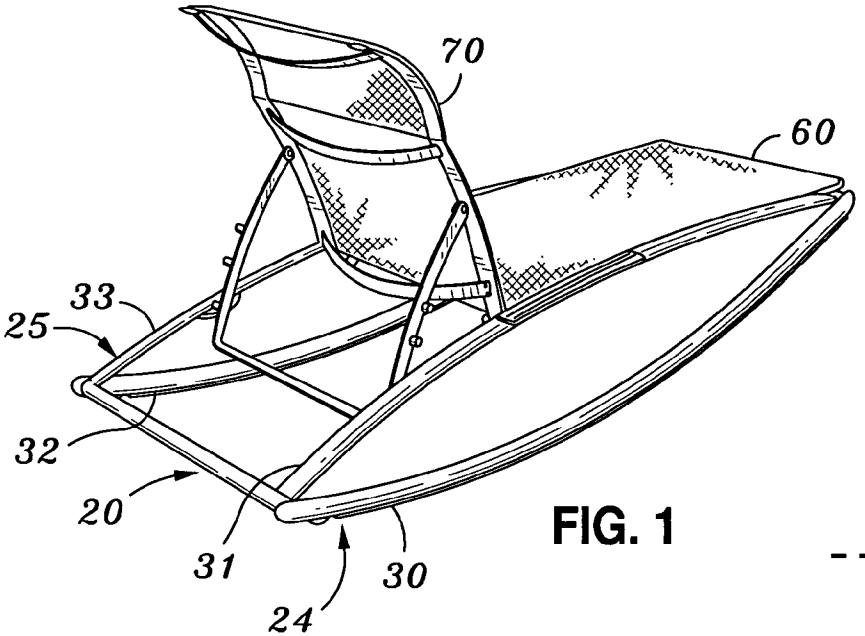
FIG. 1 is a rear right side perspective view of the preferred embodiment of the invention.
Figure 2:
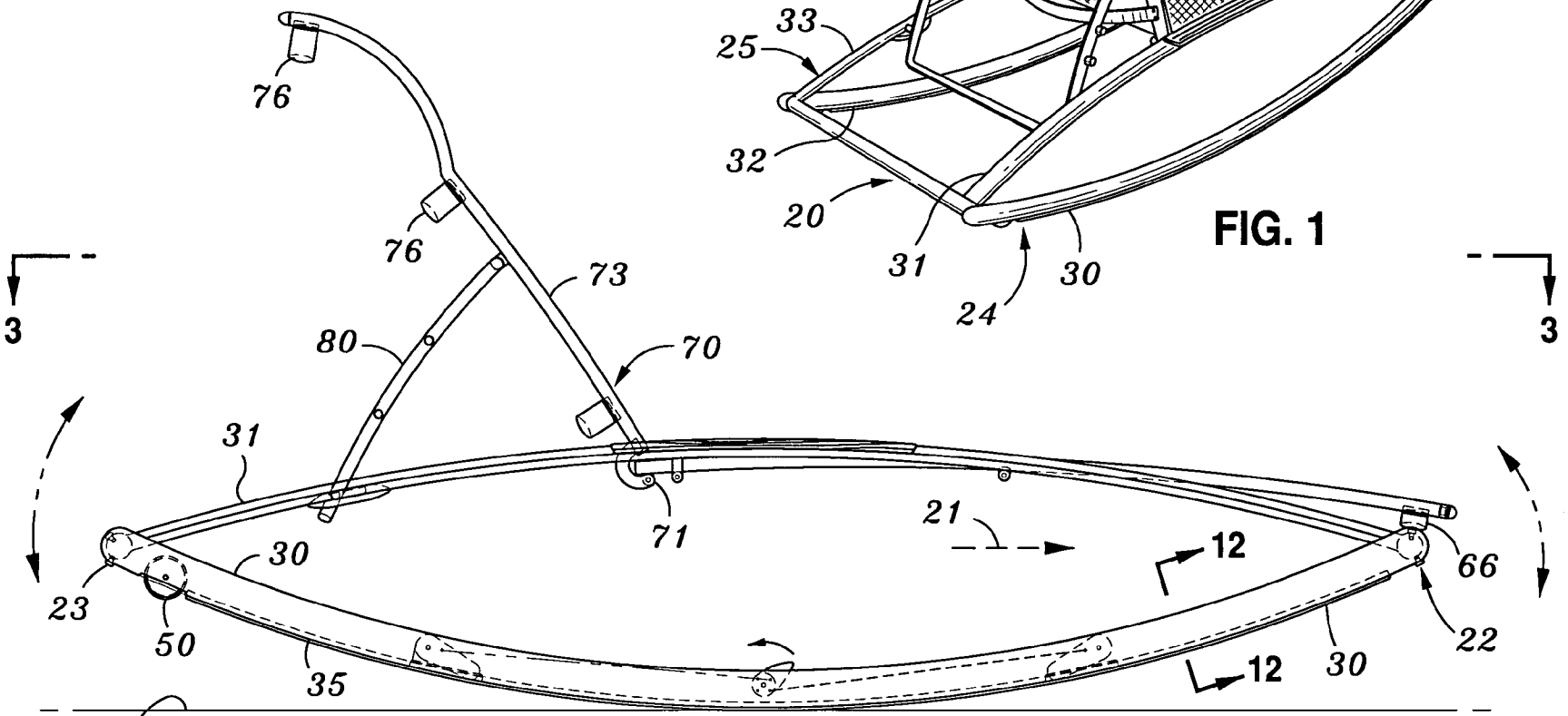
FIG. 2 is a right hand side view of the lounge of FIG. 1.

A chaise lounge 20 according to this invention has a forward axis 21, a pointed front end 22 and a pointed rear end 23. Its basic structure is a right-hand frame 24 and a left hand frame 25. These frames are rigidly joined together by a front end spreader 26 and a rear end spreader 27. Together the two frames and two spreaders form a strong unitary structure.

Right hand frame 24 comprises an arcuate rocker 30 and an arcuate rail 31. Left hand frame 25 comprises an arcuate rocker 32 and an arcuate rail 33. The rockers and rails of both frames are identical, so only rocker 30 and rail 31 will be described in detail.

Rocker 30 is arcuate. It has a center of curvature well above rail 31, and well above an occupant reclining on the lounge. This contrasts with a rocking chair in which the occupant generally sits above that center of curvature, and is much likelier to tip over. The location of the occupant within an arcuate section defined by the rocker is much more stable. The rocker has an arcuate contact surface 35 that contacts the ground 36 continuously as the lounge rocks.

In practice, the distance between the front and rear ends will ordinarily be about 78 inches and the radius of curvature at the central part of the rocker will be about 91 inches. The drawings are substantially to scale. The top of the rails is upwardly 16 inches above the ground when the lounge's level. A person sitting at that level will be well underneath the center of curvature of the rockers.

Rail 31 is preferably arcuately curved oppositely from rocker 30. At its front and rear ends it is rigidly attached to spreaders 26 and 27. These form a rigid assembly of the two rockers, two rails, and two spreaders, which will support the occupant's weight.

Figure 9:
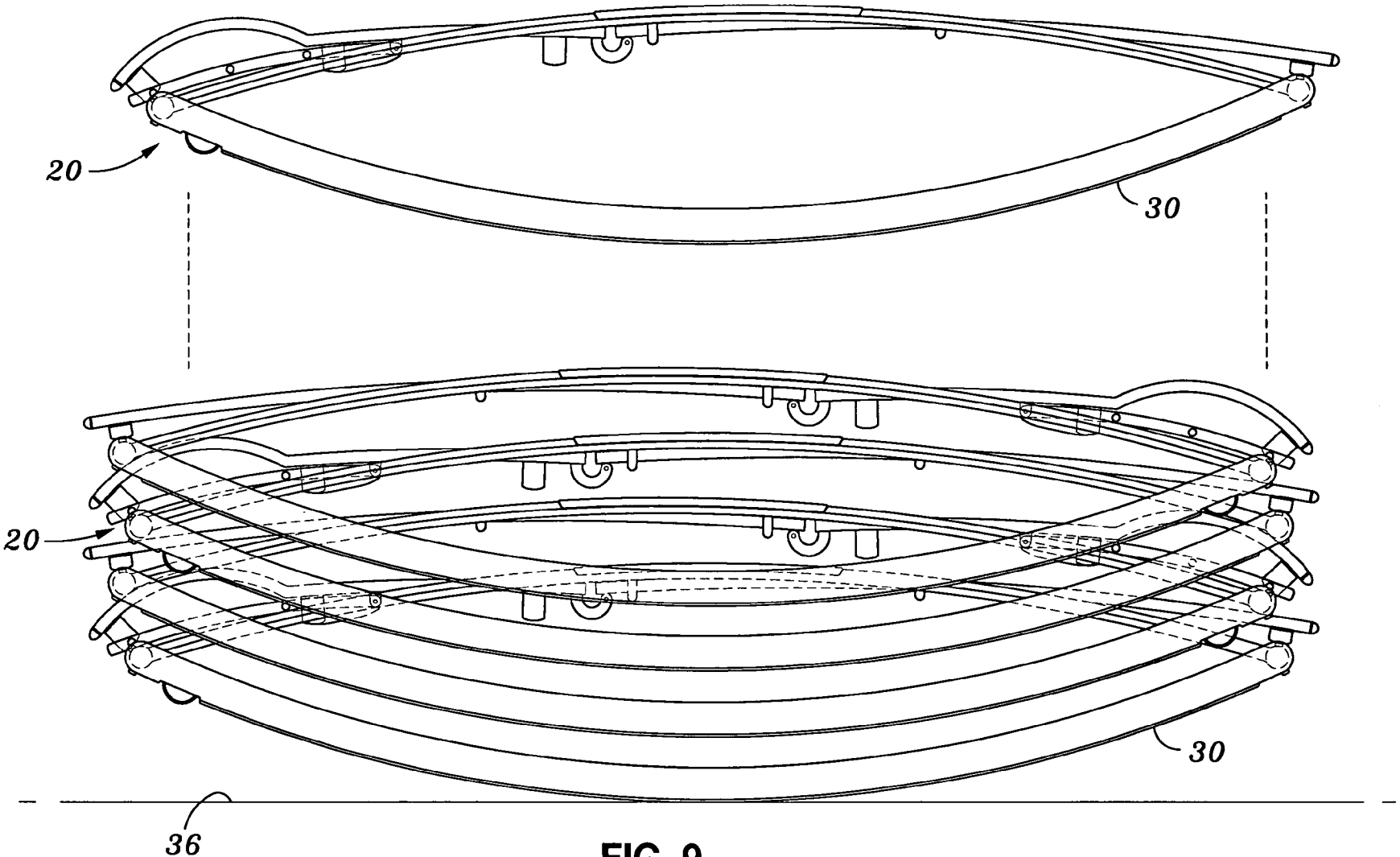
FIG. 9 is a side view showing a plurality of lounges stacked together.
Figure 11:
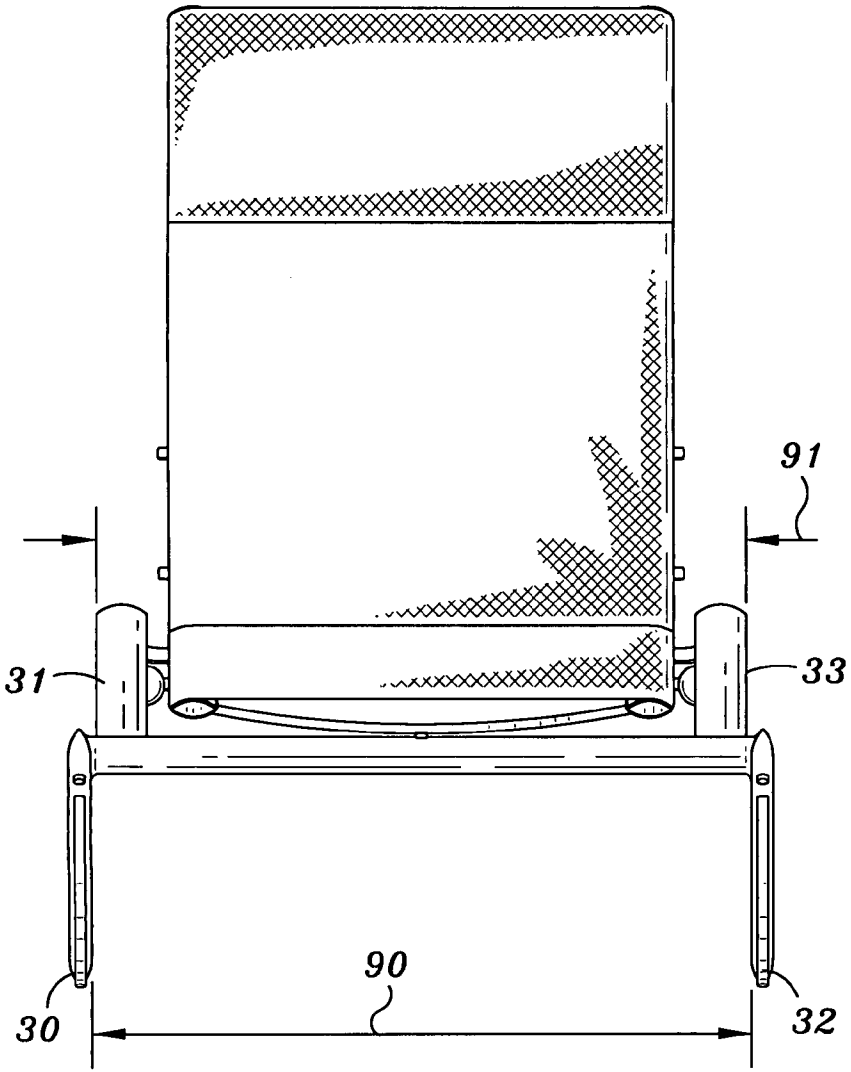
FIG. 11 is a right hand end view taken at line 11-11 in FIG. 3.

It will be observed that the lateral spacing between the inside edges of the rockers is greater than the lateral spacing between the outside edges of the rails then, as shown in FIGS. 9 and 11, these structures can be telescopically stacked, rather like the familiar Dixie cup.

The rockers, rails and spreaders, and their joinders must be strong enough to resist the weight of anticipated occupants. This is not a difficult problem because loads on the structure in excess of perhaps 500 pounds in any direction are not anticipated, and these are well within the capacity of aluminum extrusions and fittings.

For aesthetic reasons, the arc of the rails will be similar to the arc of the rockers, although they need not be. However, the reverse curvature shown provides structural advantages because when a load is placed on the rails, its tendency to flatten is resisted by the strength of the rockers, and the resistance of the frames to elongate axially. It is a very strong construction, although it can allow some limited in-plane deflection.

Figure 5:
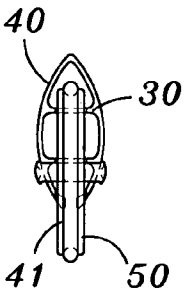
FIG. 5 is a cross-section taken at line 5-5 in FIG. 3.
Figure 4:
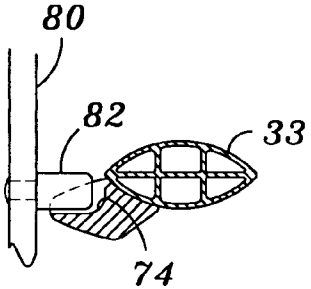
FIG. 4 is a cross-section taken at line 4-4 in FIG. 3.
Figure 12:
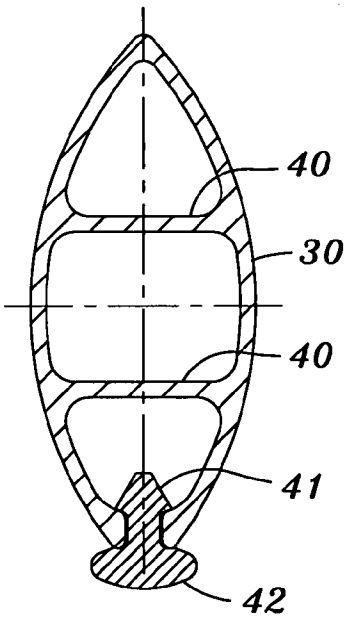
FIG. 12 is a cross-section taken at line 12-12 in FIG. 2.

The cross-sections of the rockers and rails can be designed for good appearance. For example, as shown in FIGS. 5 and 12, rocker 30 can be ovular, extruded with webs 40 for strength and lightness of weight, and with a slot 41. Along most of its length it receives and holds a vinyl bumper 42 to make contact with the ground. It is a strip extending along the contact surface of the rocker.

The use of extrusions is advantageous because curved arcuate shapes can readily be formed. When deflected, the frame resiliently resists linear extensions, the rockers and rails mutually supporting one another.

Figure 10:
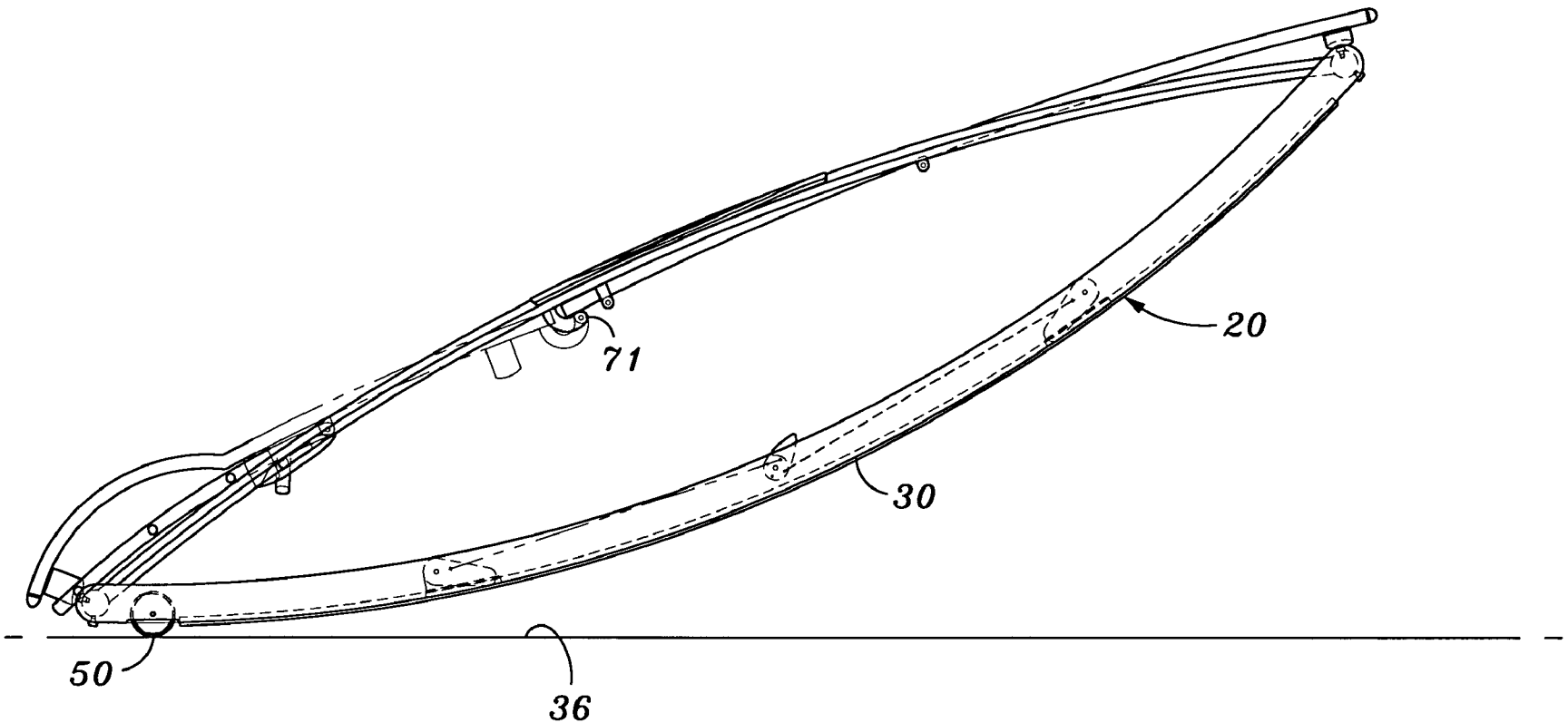
FIG. 10 shows the lounges in a wheeled configuration.

To facilitate moving the lounge, a wheel 50 is journaled in each of the rockers near the rear end. As best shown in FIG. 10, the wheel projects beyond the contact surface of the rocker to the extent that it will contact the ground and enable the lounge to be wheeled around when sufficiently tilted, but will be out of contact with the ground when the lounge is in a more level position.

Figure 8:
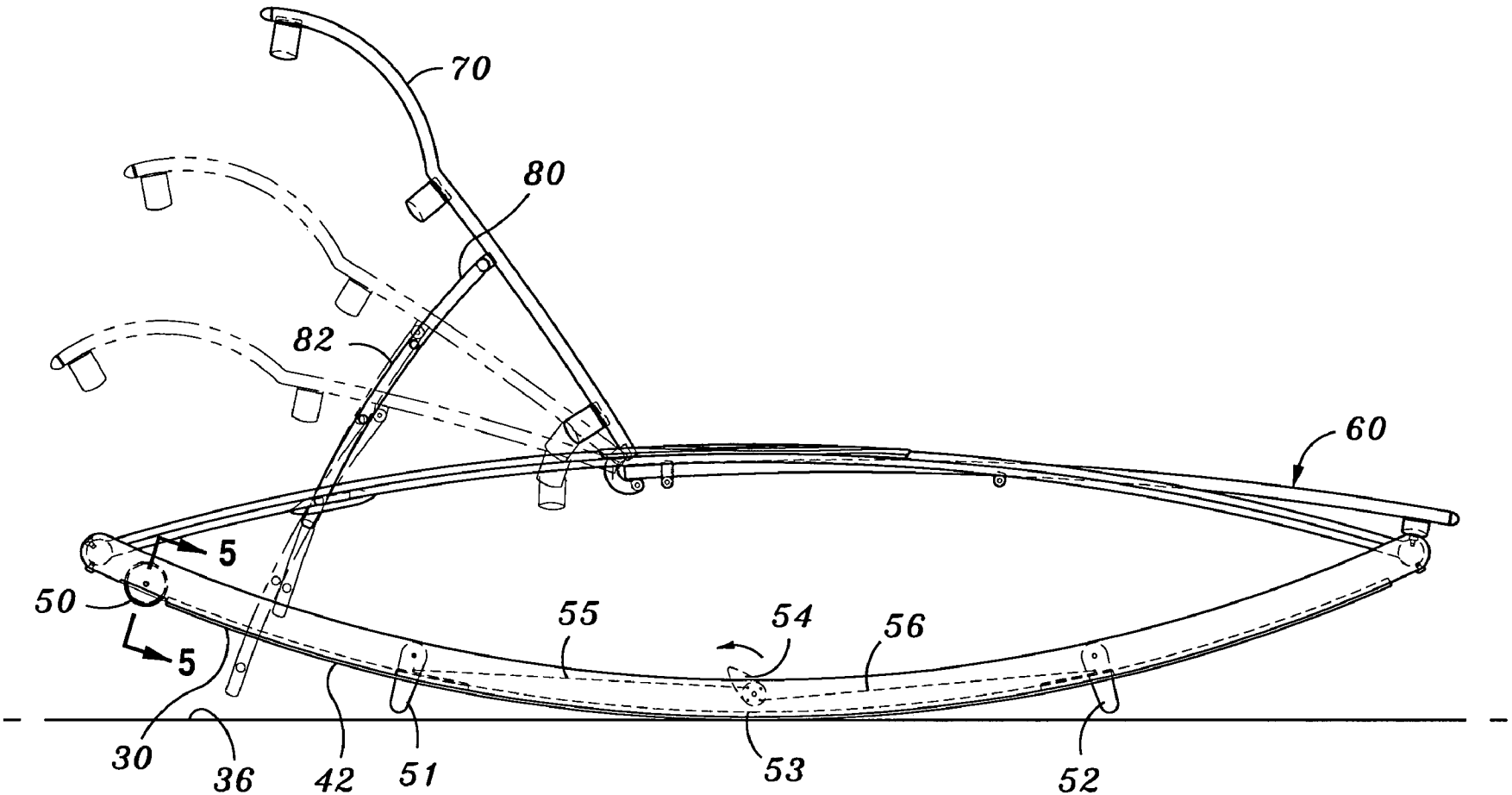
FIG. 8 is a side view similar to FIG. 2 with parts in different positions.

In addition, a pair of pivoted stops 51, 52 (FIG. 8) are spaced apart from a point of contact 53 which normally contacts the ground when the lounge is level. A hinged actuating lever 54 is linked by linkages 55,56 to stop 51 and 52 to extend or retract the stops. As shown in FIG. 8, the stops when extended can contact or nearly contact the ground to limit or to prevent entirely the rocking movement of the lounge. Often some limited rocking movement will be preferred to an absolute prevention of rocking. Also, the stops may be only partially extended adjustably by lever 54 to vary the allowable extent of rocking.

Figure 7:
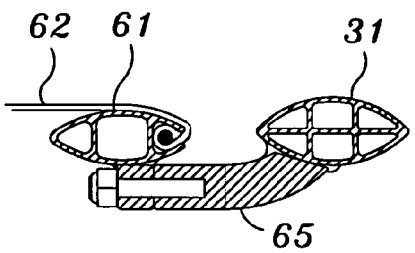
FIG. 7 is a cross-section taken at line 7-7 in FIG. 3.
Figure 6:
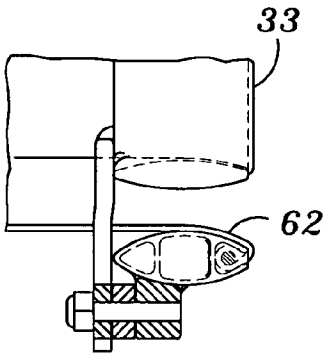
FIG. 6 is a cross-section taken at line 6-6 in FIG. 3.

A couch-like seat 60 is formed by a rigid ovular stretcher 61 (FIG. 7) that forms a frame which stretches a web 62 of flexible material to form a seat support for an occupant. Preferably the material of the web will be somewhat flexibly stretchable, perhaps as a woven fabric to give a comfortable surface for the occupant.

Stretcher 61 is supported by supports 65 on the rails. At its forward end, buffer 66 beneath the stretcher bears against front end spreader 26. Alternately, the buffers can be fixed to the spreader. Also, a buffer can be fixed to both, to meet one another.

A backrest 70 is hinged to seat 60 by hinges 71,72. It includes a rigid frame 73 that stretches a web 74 of material similar to web 62. Bumpers 76,77 on each side of the frame contact the respective rail when the backrest is fully reclined. These provide for reliable storage and facilitate stacking.

A stay 80 is hinged to frame 73 and depends toward the rear of the lounge. Engagements such as posts 82 from the stays can engage in detente 74 on the rails to adjust and hold the angular adjustment of the backrest.

Figure 3:
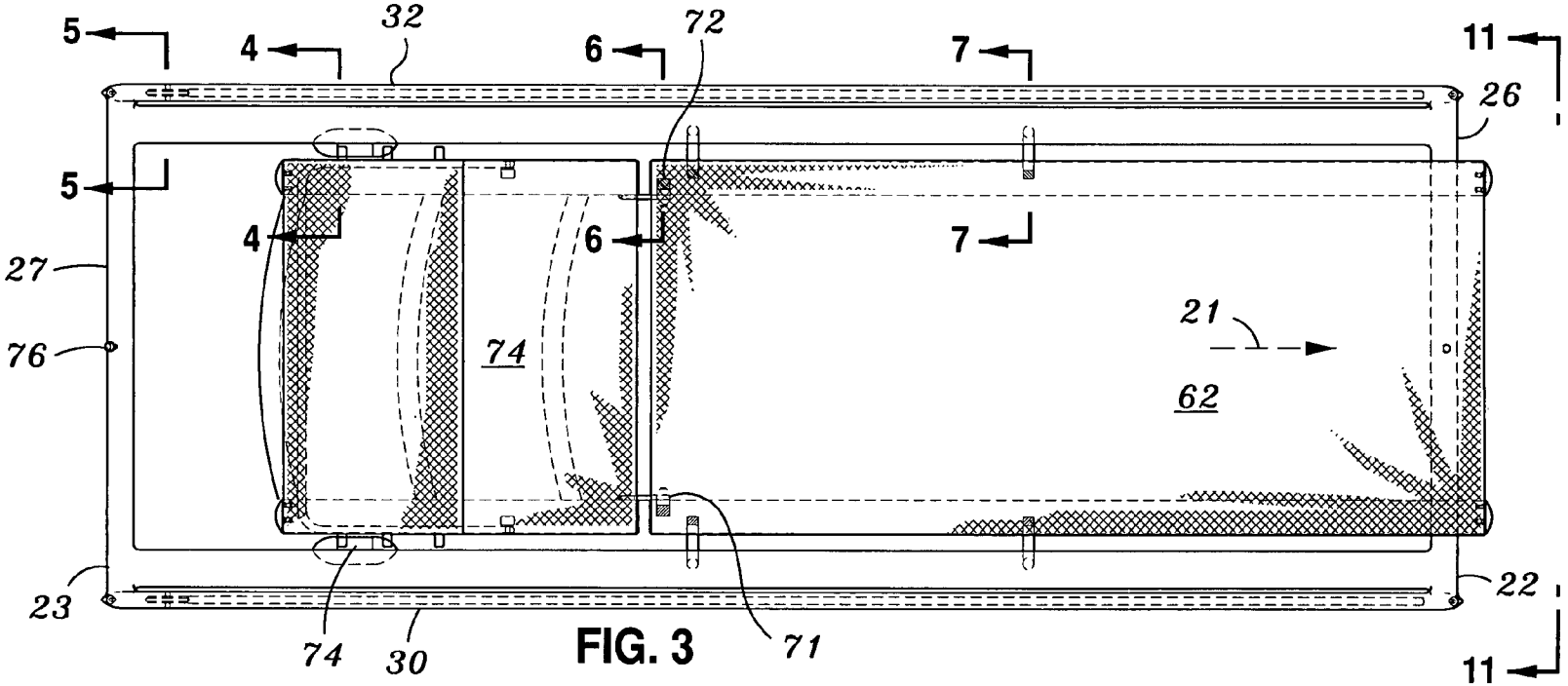
FIG. 3 is a top view of FIG. 2.

As best shown in FIGS. 3 and 11, the lateral spacing 90 between inside walls of the rockers is larger than the lateral spacing 91 between the outside walls of the rails. Thus, in the manner of the common Dixie Cup the lounges can be stacked one on top of the other, preferably alternating the direction of head and rear. It is necessary only that the spacing apart of the inner surface of the rails be larger than the spacing of the outer surfaces of the rails, so that the under part of an upper lounge will be open enough to receive the upper part of a lower lounge. A stack of these lounges is shown in FIG. 9.

This invention thereby provides an attractive, useful, dynamically rockable, convenient and affordable chaise lounge with desirable features for use, adjustment and storage.

This invention is not to be limited by the embodiment shown in the drawings and described in the description, which is given by way of example and not of limitation, but only in accordance with the scope of the appended claims.

I claim:

1. A chaise lounge comprising:

a right hand frame and a left hand frame, each frame comprising an elongated rocker formed as a segment of arc having a center of curvature and a downwardly facing convex contact surface for contacting a ground surface, and an elongated rail formed as a segment of arc facing convexly upward having a center of curvature, said rocker and rail of each frame having a front end and a rear end and being structurally connected to each other at or adjacent to their respective ends, to meet at an acute angle at a point of discontinuity between both arcs, with the curvatures of the respective rockers and rails oppositely directed:

a rigid front spreader and rigid rear spreader respectively joining the front ends and rear ends of said frame to form a unitary structure;

a seat supported on and between said rails;

a backrest hinged to said seat; and a stay hinged to said backrest, adjustably engageable to said rails to adjust the angle of the backrest relative to the seat.

2. A chaise lounge according to claim 1 in which the inner surfaces of the rockers are laterally spaced apart farther than the outer surfaces of the rails, whereby a plurality of said chaise lounges are telescopically stackable.

3. A chaise lounge according to claim 2 in which said rockers and rails are extruded metal bodies with a continuous cross-section from end to end.

4. A chaise lounge according to claim 3 in which a pair of stops are hinged to each said rocker, spaced apart along its length, one on each side of the point of contact of the rocker with the ground when the rocker is level, said stops being retractable and extendible to permit or to limit the rockability of the lounge.

5. A chaise lounge according to claim 4 in which a lever is pivotally mounted to each said rail and to said stops to move said stops between a retracted and an extended position.

6. A chaise lounge according to claim 1 in which said rockers and rails are extruded metal bodies with a continuous cross section from end to end.

7. A chaise lounge according to claim 6 in which the center of curvature of the rockers is above the anticipated height of an occupant.

8. A chaise lounge according to claim 1 in which a wheel is mounted to each of the rockers near its rear end, projecting beyond its contact surface to provide for wheeling the lounge when the lounge is sufficiently tilted.

9. A chaise lounge according to claim 1 in which a pair of stops are hinged to each said rocker, spaced apart along its length, one on each side of the point of contact of the rocker with the ground when the rocker is level, said stop being retractable and extendible to permit or to limit the rockability of the lounge.

10. A chaise lounge according to claim 9 in which a lever is pivotally mounted to each said rail and to said stops to move said stops between a retractable and an extended position.

11. A chaise lounge according to claim 1 in which a linear slot is formed in each said rocker, and a strip of resilient material is placed in said slot to project beyond the contact surface and make contact with the ground.

* * * * *